United States Patent [19]

Harrington

[11] 3,993,417

[45] Nov. 23, 1976

[54] ROTARY APPARATUS WITH AXIALLY MOVABLE VANES

[76] Inventor: Walter J. Harrington, 723 Maple St., Yukon, Okla. 73099

[22] Filed: Feb. 24, 1975

[21] Appl. No.: 552,364

[52] U.S. Cl. ..... 418/137; 418/219; 418/230

[51] Int. Cl.[2] ..... F01C 1/00; F03C 3/00; F04C 1/00; F01C 19/00

[58] Field of Search ..... 418/217, 219, 228–232, 418/136, 137, 145, 146

[56] References Cited

UNITED STATES PATENTS

| | | | |
|---|---|---|---|
| 268,195 | 11/1882 | Davis | 418/219 |
| 764,551 | 7/1904 | Bot | 418/229 |
| 859,158 | 7/1907 | Wedell | 418/231 |
| 1,686,767 | 10/1928 | Saxon | 418/219 |
| 1,786,893 | 12/1930 | Burger | 418/230 |
| 2,691,349 | 10/1954 | Cuny | 418/219 |
| 3,464,362 | 9/1969 | Ross | 418/219 |
| 3,489,126 | 1/1970 | Regar | 418/219 |
| 3,902,829 | 9/1975 | Burrowes | 418/219 |

*Primary Examiner*—John J. Vrablik
*Attorney, Agent, or Firm*—William R. Laney

[57] ABSTRACT

A positive displacement rotary apparatus comprising a rotor having opposed faces on opposite sides thereof; a housing around the rotor and having opposed internal side walls facing the opposed faces of the rotor; and a plurality of circumferentially spaced vane means extending slidingly through the rotor in a direction substantially parallel to the rotational axis thereof and disposed radially outwardly from the axis of rotation of the rotor on substantially the same radius. An annular recess which periodically varies in depth and width over its length is formed in each of said internal side walls of the housing concentrically with respect to the axis of rotation of the rotor. The annular recesses slidingly receive opposite ends of the sliding vane means, and the bottoms of the recesses are equidistantly spaced from each other at all aligned points over the length of the recesses as measured along any one vane means having its opposite ends in the recesses. Means is provided on the rotor for sealing a portion of each recess between adjacent vane means to form a chamber varying in volume as the rotor is rotated and the ends of the vane means sweep around the annular recesses. Spaced ports are provided through the housing in communication with spaced locations along the recesses to provide for timed injection and exhaustion of fluids from the chambers of varying volume defined between vane means.

5 Claims, 13 Drawing Figures

ROTARY APPARATUS WITH AXIALLY MOVABLE VANES

BACKGROUND OF THE INVENTION

1. Field of the Invention

This invention relates to energy transfer and conversion devices, such as pumps, engines and fluid proportioning apparatus, and more particularly, to a positive displacement swept volume rotary apparatus in which rotary motion is directly developed without the occurrence of low speed slippage.

2. Brief Description of the Prior Art

Various attempts have been previously made to concurrently achieve in a single machine, the advantages which characterize a positive displacement reciprocating engine or pump, and those which characterize fluid driven rotary turbines delivering rotary motion as a direct result of the transfer of energy from a power fluid to the turbine. In the case of positive displacement, reciprocating pumps and engines, the energy transfer from the power fluid to a piston is accomplished efficiently, but the net output of useful work is reduced significantly because of energy dissipation involved in the reversal of piston motion, throwing of valves, operation of associated gear trains, etc. In turbines, the uni-directional continuous operation of the rotor eliminates the energy wastage inherent in the necessity for piston reversal, operation of valving and the like, but generally entails some "slippage" in the sense of by-passing of some of the power fluid by the turbine blades with the result of reduction in the efficiency of energy transfer directly from the fluid to the turbine blades, particularly at start-up and low speeds.

Among recent devices proposed for combining the rotary motion advantages of the turbine with the principles of positive displacement energy transfer, several are described in U.S. Pat. Nos. 3,136,262; 3,166,019; and Re. 25,818, all issued to Krawacki. The Krawacki rotary motion apparatus is characterized by a rotor disposed within a ported stationary housing, and defining within the housing, a working fluid accommodation space between the rotor and housing in communication with the housing ports. A plurality of elongated sliding vanes are slidably mounted in spaced slots extending axially along the rotor, and partition the working fluid accommodation space into chambers. The sliding vanes are cammed in a reciprocating motion by stationary cam surfaces carried on the housing adjacent opposite ends of the rotor, and by virtue of the provision of selectively located slots in the vanes, the vanes alternately open close the chambers to the housing ports as the vanes are reciprocated. The Krawacki rotary motion apparatus is complex, requires careful and accurate machining of parts and entails significant energy losses in the frictional sliding of the vanes in slots extending over a major portion of the entire length of the rotor.

BRIEF DESCRIPTION OF THE PRESENT INVENTION

The present invention provides a relatively mechanical simple apparatus which combines the advantages of the positive displacement reciprocating engine with those of the turbine. The apparatus embodies principles which impart a versatility to the usages of the apparatus so that it can easily be employed, with minor changes in form, as a two or four cycle engine, as a hydraulic or gas pump, as a combination motor and pump, each operated concurrently, or as a fluid metering and proportioning apparatus.

Broadly described, the positive displacement swept volume rotary apparatus of the invention comprises a rotatably supported rotor mounted in a housing having opposed internal walls on opposite sides of the rotor and extending substantially normal to the rotational axis of the rotor. These housing walls are each grooved or recessed by an annular recess which extends concentrically about the axis of rotation of the rotor. Each of these annular recesses is of periodically varying volume over its circumference, and such variation in volume is preferably attained by varying both the depth and width of the recess. The recesses in the housing walls are aligned in the sense of being equidistantly spaced from the axis of rotation of the rotor. Moreover, the variation in the depth of the recesses is correlated so that the bottoms of the recesses are equidistantly spaced at all points therealong upon all lines extending parallel to the rotational axis of the rotor. Ports are provided through the housing and communicate with the recesses to allow fluids to be charged to, and exhausted from, the recesses.

A plurality of spaced, movable vanes project from the rotor into the recesses in the housing walls. The vanes are mounted in the rotor for rotation therewith and for movement relative thereto in a direction parallel to the axis of rotation of the rotor. The vanes cooperate with sealing means carried on the rotor to partition each of the recesses into sealed chambers between adjacent vanes.

An important object of the invention is to provide a positive displacement swept volume apparatus which is relatively simple in construction, and which achieves the advantages attributable to turbines and similar rotary motion devices without the attendant slippage usually characteristic of such devices.

A further object of the invention is to provide a structure useful as a positive displacement turbine which combines the advantages of a positive displacement reciprocating engine with those of a turbine.

Another object of the invention is to provide a positive displacement swept volume apparatus which does not require timing structures to periodically open valves or reverse pistons.

Yet another object of the invention is to provide a novel apparatus capable of displacing a volume of working fluid which is substantially exactly and constantly proportional to the angle of rotation of the input shaft, or, conversely, capable of rotating an output shaft through an angle which is substantially exactly and constantly proportional to a given volume of input working fluid.

Other objects and advantages of the invention will become apparent as the following detailed description of the invention is read in conjunction with the accompanying drawings which illustrate preferred embodiments of the invention.

GENERAL DESCRIPTION OF THE DRAWINGS

Figure 5A:
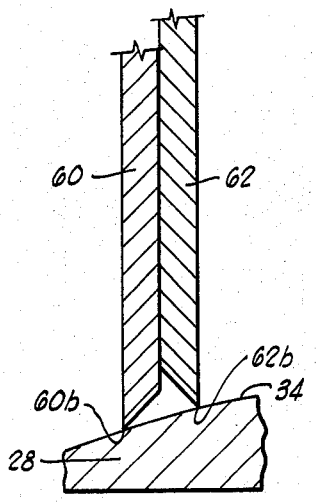
Figure 5B:
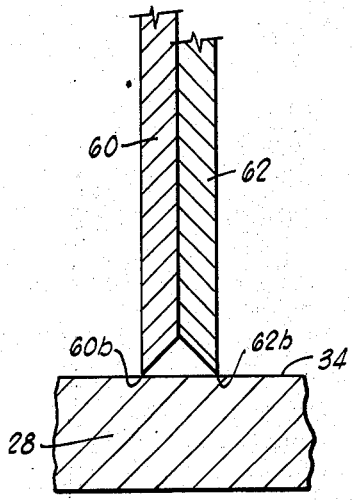
Figure 5C:
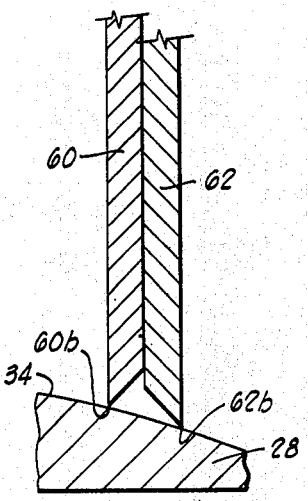

FIGS. 5*a*, 5*b* and 5*c* are detail views illustrating the construction of the end portion of a compound vane means which can be utilized in one embodiment of the present invention, and illustrating in sequential action views, the positions assumed by the end portions of the compound vane means as the vanes thereof follow recesses formed in the internal walls of the housing used in the invention.

Figure 6:
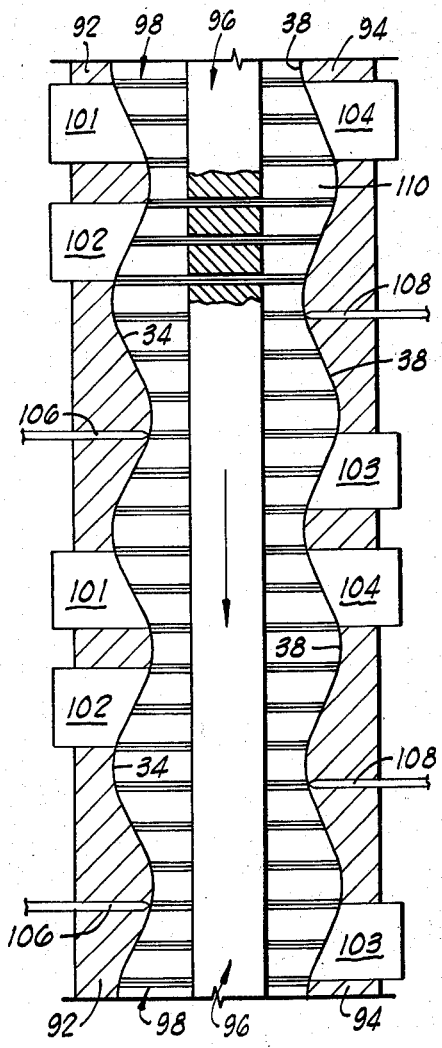

FIG. 6 is a diagrammatic illustration of two cycles of the operating sequence which occur during the operation of one embodiment of the invention.

Figure 7:
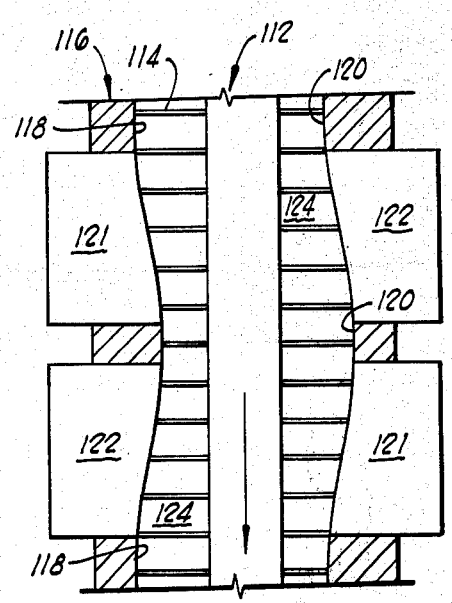

FIG. 7 is a diagrammatic illustration of the mode of operation of a different form of the invention.

Figure 8:
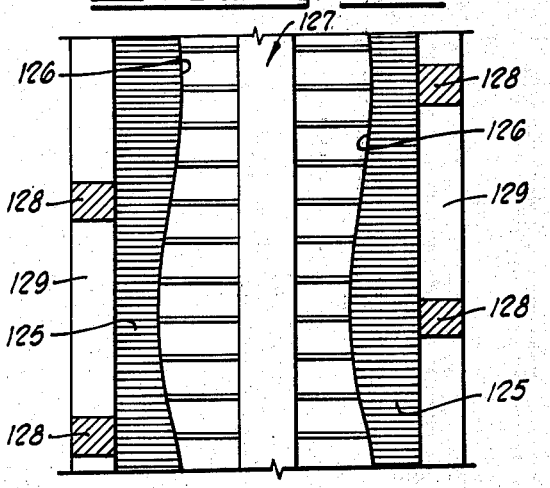

FIG. 8 is a diagrammatic illustration of yet another embodiment of the invention.

Figure 9:
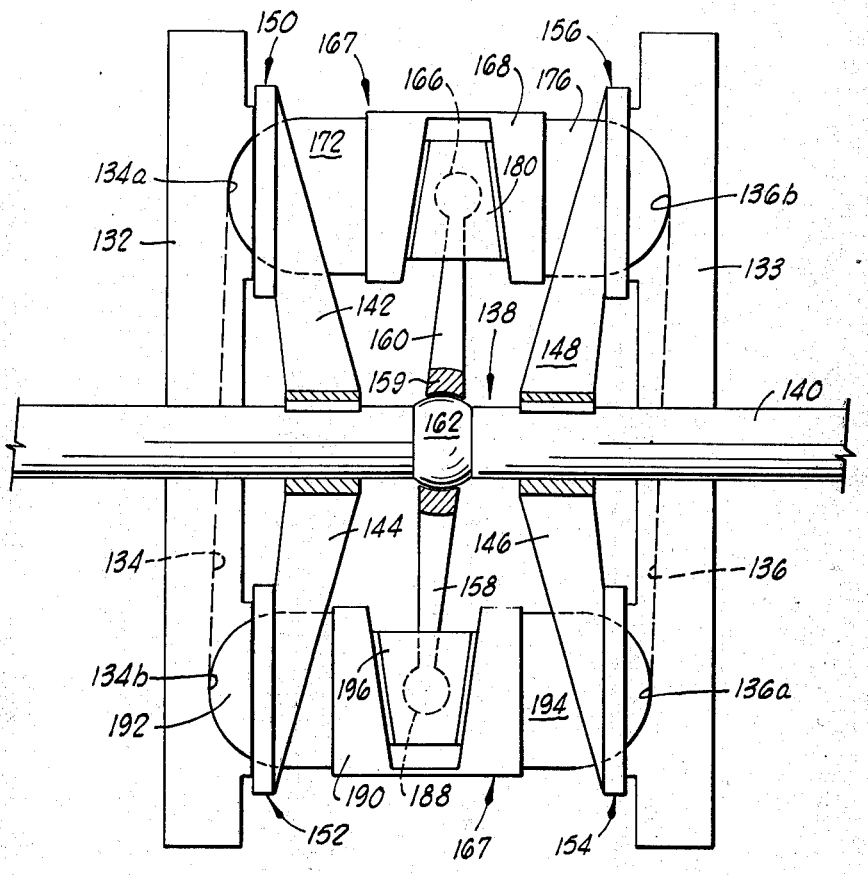

FIG. 9 is a diagrammatic illustration of a different embodiment of the invention.

Figure 10:
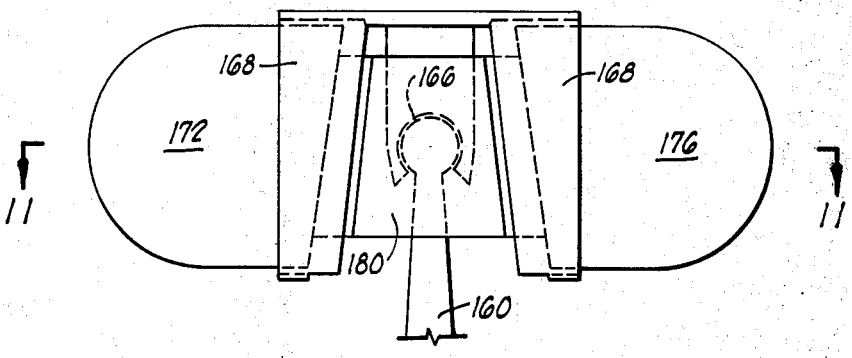

FIG. 10 is a detailed side elevation view of the spoke and vane structure utilized in the embodiment of the invention shown in FIG. 9.

Figure 11:
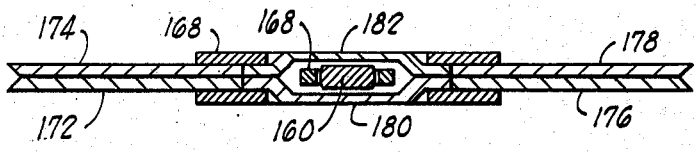

FIG. 11 is a sectional view taken along line 11—11 of FIG. 10.

DETAILED DESCRIPTION OF PREFERRED EMBODIMENTS OF THE INVENTION

Figure 1:
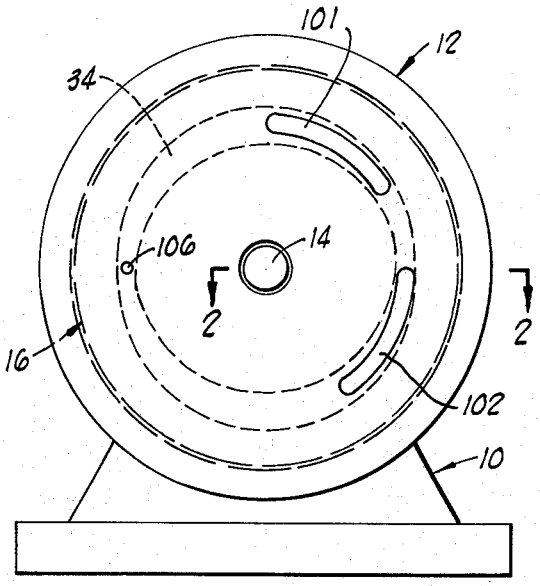
FIG. 1 is a side elevation view of one embodiment of the apparatus of the invention, illustrating in dashed lines, the location of certain recesses inside a housing forming a part of the invention, and also illustrating, in dashed lines, the periphery of a rotor employed as a portion of the invention.

Referring initially to FIG. 1 of the drawings, shown therein is a positive displacement turbine constructed in accordance with one embodiment of the invention. The positive displacement turbine includes a supporting base designated generally by reference numeral 10. The base 10 has mounted thereon a generally cylindrical stationary housing designated generally by reference numeral 12. Enclosed within the housing 12 and keyed for rotation therewith to a shaft 14 which extends through suitable bearings in the housing is a rotor designated generally by reference numeral 16.

Figure 2:
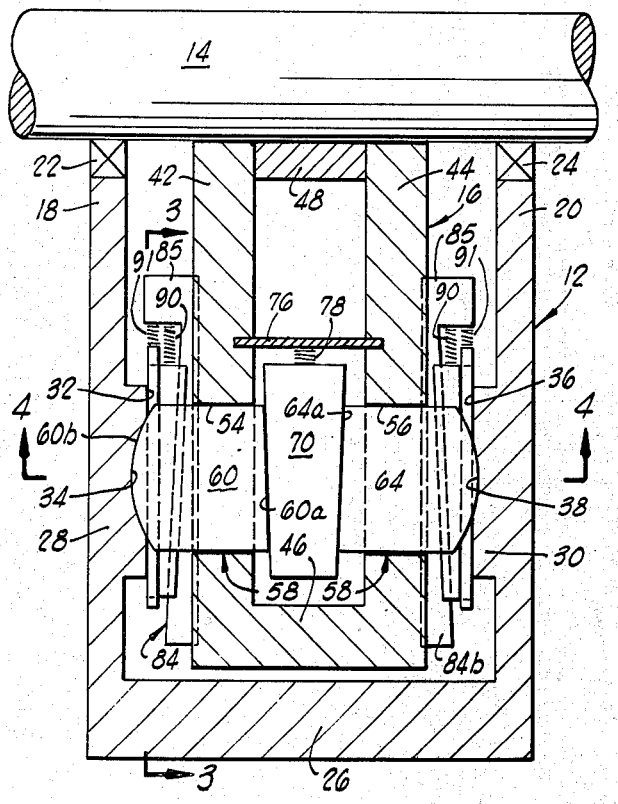
FIG. 2 is a sectional view, taken along line 2—2 of FIG. 1.

As shown in FIGS. 1 and 2, the housing 12 includes opposing, substantially planar side walls 18 and 20 each having a central opening or aperture therethrough for accommodating bearings 22 and 24 which journal the shaft 14. A cylindrical end wall 26 forms a closure for the outer periphery of the housing 12 and extends between side walls 18 and 20. In the illustrated embodiment, each of the side walls 18 and 20 has a built-up internal annular portion 28 and 30, respectively, which annular portion, in each case, extends concentrically around the shaft 14.

The built-up annular portion 28 includes an inwardly facing, substantially planar surface 32 which has formed therein, an annular groove or recess 34. The annular recess 34 varies in its depth and in its width, with such width variation being illustrated in dashed lines in FIG. 1. In like manner, the built-up portion 30 on the side wall 20 has an inwardly facing surface 36 thereon, which surface has formed therein a groove or recess 38. The recess 38 also varies in depth and in width similarly to the recess 34. Both of the recesses 34 and 38 extend concentrically around the shaft 34.

For a purpose which will subsequently be better understood, the depth of the recesses 34 and 38 vary regularly and periodically over the length or entire circumference of these recesses and in a correlated fashion so that the distance between two points in the bottoms of the two recesses, as measured along any line extending parallel to the axis of the shaft 14, is always constant. This relationship may be better understood by referring to FIG. 6 of the drawings which is a diagrammatic illustration in which the varying depths of the recesses 34 and 38 are diagrammatically illustrated. It will be perceived in referring to FIG. 6, which will be hereinafter discussed in greater detail, that the bottom of each of these recesses is configured as a sinusoidal curve, with the phase relationship between the curves (representing the bottoms of the recesses 34 and 38) being such that the bottoms of the recesses are always located equidistantly from each other along lines which extend perpendicularly to the faces of the rotor 16 (or parallel to the axis of rotation of the rotor).

Figure 3:
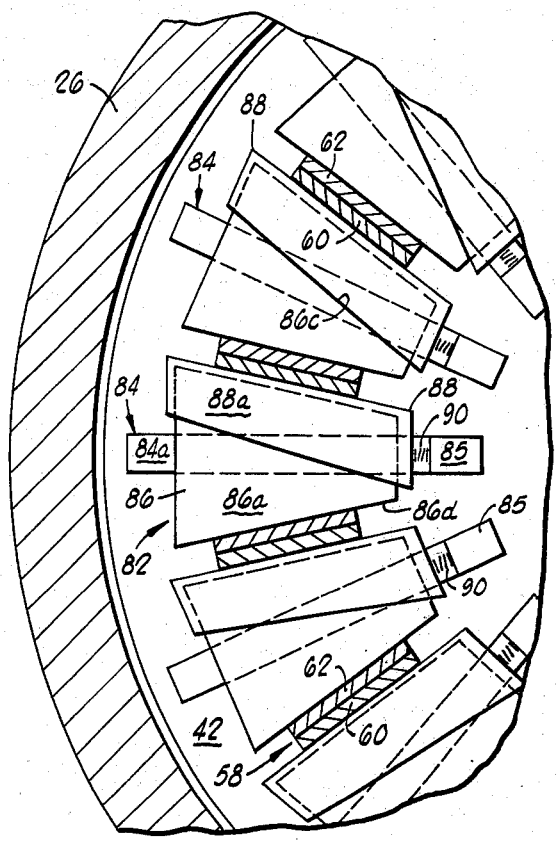
FIG. 3 is a sectional view, taken along line 3—3 of FIG. 2.
Figure 4:
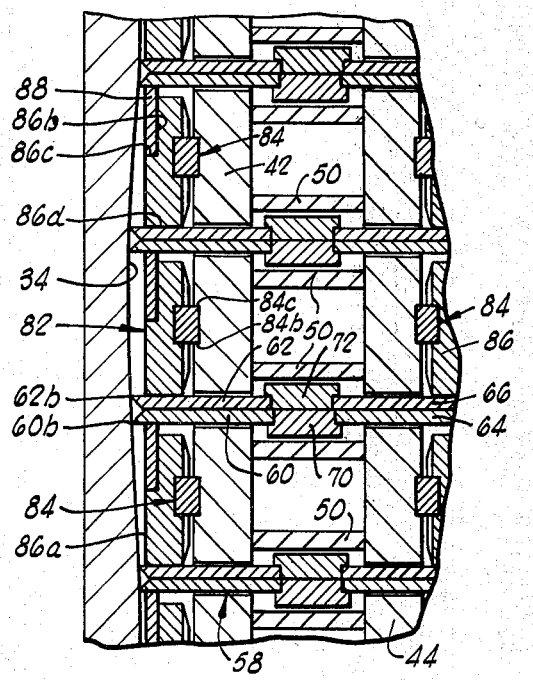
FIG. 4 is a sectional view, taken along line 4—4 of FIG. 2.

Mounted on the side walls 42 and 44 of the rotor at a position between adjacent vane pairs are a plurality of sealing means designated generally by reference numeral 82. The details of construction of the sealing means is best illustrated in FIGS. 2–4 of the drawings. Each of the sealing means 82 includes a radially extending ramp 84 secured to the outer side or surface of the respective side wall 42 or 44 of the rotor 16. Each ramp 84 has an inclined outer surface 84*a* which is inclined in a radially outward direction, or, stated differently, extends from a point located relatively distally with respect to the side walls 18 and 20 of the housing 12 to a point more closely located with respect to these walls at the radially outer end of the ramp as best shown in FIG. 2. Described yet differently, each ramp 84 has its thinnest end at its radially inner end which is relatively close to the shaft 14, and its thickest end located farthest from the shaft 14 in a radial direction. Each of the ramps 84 is substantially rectangular in cross-section and thus, has a pair of opposed, substantially parallel, side walls 84*b* and 84*c* (See FIGS. 2 and 4). A spring stop shoulder, or abutment 85 is formed on the radially inner end of each of the ramps 84 and projects toward the adjacent side wall 18 or 20 of the housing 12.

Slidably mounted on each of the ramps 84 by means of a slot formed in the lower side thereof is a trapezoidally shaped primary wedge plate 86. The trapezoidally-shaped primary wedge plate 86 is trapezoidal in configuration both as viewed in plan (as the plate appears in FIG. 3) and as viewed in side elevation (as the plate is seen in FIG. 2). Each primary wedge plate 86 is configured so that, when it is slidably mounted on its respective ramp 84, it presents a first exposed outer surface 86*a* which extends substantially parallel to the side walls 18 and 20 of the housing 12 and to the planar surfaces, 32 and 36, carried on the built-up annular portions 28 and 30. The exposed planar surface 86*a* of each primary wedge plate 86 is relieved so as to provide a second surface 86*b* (see FIG. 4) which surface also extends parallel to the surfaces 32 and 36 and is bounded by a shoulder 86*c* resulting from the relief. The shoulder 86*c* extends at an angle to the major longitudinal axis of the respective rib 84 upon which the respective wedge plate 86 is slidably mounted.

A secondary wedge plate 88 of trapezoidal configuration is slidably mounted on the surface 86*b* of the wedge plate 86. As shown in FIG. 4, the secondary wedge plate 88 is a flat plate of uniform thickness, and is dimensioned so that it has an outwardly facing surface 88*a* which is in coplanar alignment with the surface 86*a* of the primary wedge plate 86. It will be noted in referring to FIG. 3 that the small end of the primary wedge plate 86*a* is disposed radially inwardly with respect to its large end, and that the shoulder 86*c* diverges in a radially outwardly extending direction from a side edge 86*d* of the primary wedge plate. Thus, it will be perceived that, as the secondary wedge plate 88 slides radially outwardly on the primary wedge plate 86, it will be biased in a direction away from the side edge 86*d* of the primary wedge plate by its contact with the shoulder 86*c*. For purposes of closure and sealing of the annular recesses 34 and 38 between the spaced vane means 58, both the primary wedge plate 86 and the secondary wedge plate 88 are substantially wider, in a radial sense, than the vanes 60–66, utilized in the several vane means. A helical compression spring 90 is positioned between the radially inner end of each of the primary wedge plates 86 and the adjacent spring abutment 85 carried on the respective ramp 84. A helical compression spring 91 also bears against the radially inner end of each secondary wedge plate 88.

In FIG. 6 of the drawings, an operating diagram is presented which diagrammatically illustrates the operating principles of one embodiment of the invention. FIG. 6 schematically illustrates two complete cycles of the rotor 16, and shows the sequential positions assumed by the sliding vane means which extend parallel to the axis of rotation of the rotor as these vane means follow the contours of the recesses 34 and 38 formed in the opposed, built-up, internal annular portions 28 and 30. For purposes of simplification, the walls 18 and 20 of the housing 12 have been composited with the built-up, internal annular portion 28 and 30, so that the wall 18 and built-up portion 28 are represented by the structure 92, and the wall 20 and the built-up portion 30 are represented by the structure 94. The sinusoidal variation in depth of the recess 34 and of the recess 38 are shown by the sinuous lines of the same number in FIG. 6, and the rotor, schematically illustrated therein, is designated by reference numeral 96. The vane means 58, previously referred to as being slidably mounted in the slots 54 and 56 formed through the side walls 42 and 44 of the rotor, have been illustrated schematically in FIG. 6, and are there designated by reference numeral 98.

The two exhaust ports 101 aand 103 extend through the opposed side walls of the housing and communicate with the recesses 34 and 38 respectively. Since two complete rotations of the rotor 96 are here diagrammatically illustrated, the exhaust ports 101 and 103 appear twice in the diagram of FIG. 6. In like manner, intake port 102 is shown extending through the side wall 92, and intake port 104 is shown extending through the side wall 94. Fuel injection ports 106 and 108 are provided for injecting fuel through the side walls 92 and 94, respectively, of the housing into the recesses 34 and 38, respectively.

OPERATION

The operation of the positive displacement swept volume rotary apparatus of the present invention will be described by referring concurrently to FIGS. 1–6 of the drawings. FIGS. 1–5 illustrate one structural embodiment of the invention which can be employed as a positive displacement turbine, and such operation and use of the apparatus is diagrammatically illustrated in FIG. 6 for a four-cycle, diesel powered turbine. Referring initially to FIGS. 1 and 6 of the drawings, the rotor 16 is, as previously described, mounted in the housing 12 for rotation on the shaft 14. This shaft may be considered, in this description of the operation of one embodiment of the invention, as a power output shaft, which can be coupled to various types of kinematic trains or power transmission systems. In starting up the apparatus, the shaft 14 may be turned by a suitable starter mechanism and, in undergoing rotation, causes rotation of the rotor 16. As the rotor 16 rotates within the housing 12, the several vane means 58 track along the recesses 34 and 38 formed in the annular built-up portions 28 and 30. The vane means 58 are all of equal length, as measured between the arcuate outer edges of the opposed vanes in each opposed vane pair. The vane means are therefore each caused to undergo a reciprocating motion transversely of the rotor 12 (or parallel to the shaft 14) as the depths of the recesses 34 and 38 increase and decrease sinusoidally, since a constant distance exists between any two points located in the two recesses and on a line extending between such two points parallel to the shaft 14. This movement of the vane means 58 is facilitated by the sliding mounting of the vanes in the slots 54 and 56 in the walls 42 and 44 of the rotor 16.

As previously explained, the arcuate outer edges 60*b*–66*b* of the several vanes 60–66 in each vane means 58 sealingly engage the arcuate surfaces defining the respective recesses 34 and 38. The vanes 60–66 are continuously and constantly biased into sealing engagement with the defining boundary surfaces of the recesses 34 and 38 by the wedging action of the wedges 70 and 72 which are continuously urged in a wedging movement by centrifugal force. At low speeds of the rotor 16, the wedging action is attained by the bias of the compression springs 78 and 80.

It will also be noted that the compound vane structure of each vane means 58 assures that a double line of sealing is afforded by the tapered outer edges of each pair of vanes in the vane pairs in the manner shown in FIGS. 5A–5C. This is a particularly effective sealing structure where it is necessary for the vanes to follow a continually changing slope such as that characteristic of the recesses 34 and 38. It should also be pointed out that the use of the compound or dual vane structure in the vane means 58 facilitates the charging of a lubricant through a small capillary passageway between the vanes in each pair so that such lubricant will fill the confined space between the tapered outer edges of the vanes in each pair, and thereby assist in the sealing function of the vanes, and also in reducing the frictional opposition to their tracking movement in the recesses 34 and 38.

It will be perceived from the description of the invention to this point that the adjacent vane means 58 partition the grooves 34 and 38 into sections located between adjacent pairs of vane means. In order to close these sections of the recesses 34 and 38 to provide contiguous chambers between adjacent vane pairs, the several sealing means 82 are employed. As shown in FIG. 2, the outwardly facing planar surfaces 86*a* and 88*a* carried on the primary and secondary wedge plates 86 and 88 bear against the planar surfaces 32 and 36 formed at the inner side of the built-up internal annular portions 28 and 30 carried on the side walls 18 and 20. The surfaces 86*a* and 88*a* are continuously biased into sealing engagement with the respective surfaces 32 and 36 by the proclivity of the primary wedge plate 86 to be moved upwardly on the ramp 84 by centrifugal force developed during rotation of the rotor. The secondary wedge plate 88 is also urged in a radially outwardly direction by the centrifugal force acting during rotation of the rotor. A seal is thus provided over the areas of contact between the surfaces 86*a* and 88*a* and the surface 32 bounding the recess 34 and the surface 36 bounding the recess 38 and, in effect, a cover, ceiling or lid thus closes the upper side of the recesses between adjacent vane means 58.

It is further necessary, in order to seal the recess against escape of fluids therefrom, to have the wedge plates 86 and 88 sealingly engage the adjacent sides of the vanes in adjacent vane means 58. This sealing action is also accomplished as a result of the particular configuration of the wedge plates 86 and 88, and by the action of centrifugal force. Thus, as the rotor 16 undergoes rotation, the secondary wedge plate 88 is urged outwardly on the primary wedge plate 86, and such outward movement tends to move the secondary wedge plate against the vane means with which it is in contact at its outer side edge as the secondary wedge plate follows the shoulder 86*c* of the primary wedge plate. Since the vanes of each vane means 58 can be canted slightly at the respective slots 54 and 56 through the rotor walls 42 and 44, pressure of the wedge plate 88*a* against the adjacent vane means 58 tends to force this vane means against the adjacent edge of the primary wedge plate 86 located on the opposite side thereof. Thus, sealing engagement is afforded between each of the sealing means 82 and the pair of vane means 58 disposed on opposite sides thereof.

From the foregoing description of the action of the sealing means 82, it will be perceived that the sealing means functions to provide a covering structure extending across and closing the upper sides of each of the segments of each recess 34 and 38 located between adjacent pairs of vane means. The sealing means 82 also makes a fluid tight seal at its side edges against the planar surfaces at the sides of the adjacent vanes in the pairs of vane means disposed on opposite sides of each of the sealing means. It will therefore be apparent that each of the recesses 34 and 38 is divided into a plurality of closed chambers which are, in each case, defined by the arcuate bottom wall or boundary of the respective recess, the planar surfaces 86*a* and 88*a* of the primary and secondary wedge plates 86 and 88, respectively, and, the facing or opposed vanes in each adjacent pair of adjacent vane means 58.

From the previous description of the manner in which the depth and width of the recesses 34 and 38 undergo variation in a sinusoidal fashion, it will further be understood that the volume of each of the described chambers will vary from relatively small to relatively large as the vane means 58 and their associated sealing means 82 traverse the circular extent of the two recesses as the rotor rotates. The change in volume of each chamber is rhythmic or cyclical and varies in amplitude according to a sine function as the recesses vary in depth and width in the manner diagrammatically illustrated in FIG. 6 of the drawings. As previously indicated, this figure diagrammatically portrays two full revolutions of the rotor 16 when the apparatus illustrated in FIGS. 1–5 is used as a four-cycle diesel engine. The chambers defined between the vane means 98 are diagrammatically illustrated and are designated by reference numeral 110. It will be noted that the recess-defining boundaries of each of these chambers is displaced from the recess-defining boundary of a chamber on the opposite side of the rotor, but defined between the same vane means 98, by 180° on the sine curve represented by the recess boundaries.

As the rotor 96 rotates, the vanes 60–66 are positively positioned by the camming action of the opposing curved surfaces of the recesses 34 and 38. During rotation, the volume of each chamber 110 between adjacent vanes varies sinusoidally from a maximum volume to a minimum volume. In the course of operation, air is admitted through the intake port 104 to chambers 110 defined between two pairs of vane means 98. The location of the intake port 104 is such that the air is charged to the chambers 110 as they are increasing in volume - that is, as the depth and width of the respective recesses 34 and 38 are increasing. Soon after the admission of air to the volumetrically increasing chambers, the maximum volume for the charged chambers is achieved, and the trailing vane seals the charged chambers, at maximum volume, away from the intake port 104.

As the rotor 96 continues to rotate, the vane means 98 are biased slidingly in the opposite directions so that the volume of the chambers 110 defined between adjacent vane means 98 commences to decrease. This results in compression of the air contained within the several chambers 110 of decreasing volume, and such compression continues until maximum compression is achieved where the respective recess is the shallowest in depth, and the narrowest in width. At this point, diesel fuel is injected from the fuel injection port 108 into the highly compressed air and combustion follows. The occurrence of combustion suddenly and substantially increased the pressure within the chamber 110 which at this time has begin its volumetric enlargement as a result of the increasing depth of the recess.

It will be perceived in referring to FIG. 6, that at this point in the rotor cycle, a greater area on the leading vanes which define the chambers of increasing volume is exposed than on the trailing vanes (considering that the rotor is rotating in a downwardly direction as shown in FIG. 6.) Since the pressure developed by the combustion occurring in any chamber 110 is felt equally on all the confining surfaces of the chamber, a greater force acts against the exposed surface of the leading vane than upon the relatively smaller exposed surface of the trailing vane. Therefore, a net force is developed which causes the rotor to move in its intended direction of rotation (downwardly as shown in FIG. 6). The net force is felt as torque, and is applied at a right angle to the radius of the wheel carrying the vane means. Rotation of the rotor is thus produced and the shaft is driven in rotation.

Upon the development of maximum volume of each chamber in which combustion has occurred, and thus, at the point where the driving pressure has decreased to the lowest point, the leading vane defining each such chamber uncovers the exhaust port 103. The exhaust port 103 then remains in communication with the chamber until the chamber is closed off from the exhaust port by the trailing vane in its continued movement along the sinusoidally curved arcuate surface of the recess. At substantially the same time that the exhaust port is isolated from the moving chamber by the closure afforded by the trailing vane, the leading vane of the chamber will uncover the intake port, and repetition of the cycle will be commenced.

The four stroke cycle which is undergone by one of the chambers has been described, but it will be understood that all of the chambers on both sides of the rotor 96 are undergoing identical four-stroke cycles. The cycles on one of the rotors is displaced in time from the cycle on the opposite side of the rotor, (as a result of the sinusoidal phase relationship between the curvatures of the two recesses), so that substantially constant torque is produced and imparted to the rotor. In other words, at the time that the chambers on one side of the rotor experience combustion with a resultant driving force being applied to the leading vane thereof, the chambers immediately opposite these chambers on the opposite side of the rotor are undergoing the compression phase of the cycle.

FIG. 6 is presented with the intention of illustrating in a simple diagrammatic fashion how the principles of the invention are used in a four-stroke diesel engine, and in order to more clearly illustrate the principle of the sliding vanes and the sinusoidal volumetric development of the recesses 34 and 38. Consideration of this diagrammatic view may lead the reader to an exaggerated conception of the magnitude of sliding motion of the vane means which is required. Since the reciprocating motion of the vane means through the rotor involves energy-consuming acceleration of the masses of the vane means, it is desirable to minimize this motion as much as possible, so that the energy necessary to accelerate the vanes in their reciprocating movement does not significantly decrease the net output torque of the engine. By forming the bounding surface of each of the recesses on a segment of a circle, and by making the outer ends of the several vanes of arcuate configuration and formed on an identical circle segment, a relatively large change in the volume of the confined chambers is achieved for a relatively small reciprocating displacement of the defining vane means. This particular shape of the recesses also simplifies the machining of the recesses, and facilitates the sealing of the chambers in the manner hereinbefore described.

It will be perceived that the wedging action which is continuously in effect as a result of the bias developed by the wedges 70 and 71 assures continuous compensation for any dimensional changes that may occur in the overall length of the vane means due to wear as the device is operated over an extended period of time. Moreover, the relatively thin or outer edges **60*b*–66*b* of the vanes 60–66 assure that these edges of the vanes can accommodate themselves, through gradual wear, to geometric or dimensional variations due to wear occurring at the defining surfaces of the recesses 34 and 38. The same type of continuous compensation is afforded by the construction of the sealing means 82. There, the primary and secondary wedge plates 86 and 88 are continuously biased in a direction to seal against the surfaces 32 and 36 of the built-up annular portions 28 and 30, and also to maintain the seal between the side edges of the respective wedge plates and the adjacent pairs of the vane means 58.**

Although not shown in the drawings, means is provided in a preferred embodiment of the invention to continuously supply lubricant under pressure through the rotor and its shaft to the sliding vanes so as to enable them to slide more easily and with less frictional resistance through the slots 54 and 56 formed in the side walls 42 and 44 of the rotor 16. Means is also provided for supplying lubricant to each of the sealing means 82 so that the primary wedge plate 86 can slide more easily on the ramp 84, and the secondary wedge plate 88 can slide more easily on the primary wedge plate. It should be further pointed out that it is a preferred practice of the invention to construct the vanes 60–66 of a synthetic resin material having a lower coefficient of friction, such as Teflon, and to also construct all wedging surfaces, particularly those utilized in the sealing means 82, of similar material, so as to reduce the frictional resistance to the turning of the rotor.

The positive displacement turbine principle as used in a four-stroke diesel engine, has been described in detail in referring to the foregoing drawings. The basic principles of the invention, however, lend themselves to any application requiring a device producing a swept volume of known dimensions. Thus, a similar positive displacement turbine can easily be built to employ a two-stroke cycle, with the only change required being that entailed in shaping and venting the non-rotating recesses in which the vanes move.

FIG. 7 is a diagram schematically illustrating how the recesses could be formed and positioned in relation to intake and exhaust ports in order to produce a two-stroke pumping action. As in the case of FIG. 6, the rotor is schematically illustrated and is designated generally by reference numeral 112. The rotor 112 is shown by the arrow thereon as turning in a direction downwardly on the page. The diagram shows, as a diagrammatic time sequence illustration, one full cycle, or 360°, of the rotation of the rotor. In this arrangement, the groove or recess receiving the ends of sliding vane means 114 and formed in one side wall of the housing 116 has been designated by reference numeral 118, and the opposing recess in the opposide side wall of the housing is designated by reference numeral 120. The self-adjusting vane means 114 are shown extending through the rotor 112 and projecting on opposite sides thereof, with the end portions of the vane means extending into the recesses 118 and 120 as previously described.

In the two-stroke apparatus diagrammatically illustrated in FIG. 7, exhaust ports 121 are shown located on opposite sides of the housing 116 from intake ports 122. It will be observed, in referring to only one side of the rotor 112 and to the action of the vane means on that side of the rotor with respect to the recess 118, that the chambers 124 defined between adjacent vane means are filled with a fluid charged through the intake port 122 as the volumes of the chambers increase due to the curvature and shape of the recess 118. When the leading chamber 124 has attained maximum volume, the trailing vane means which defines that chamber isolates the chamber from the intake port 122. Thereafter, the chambers commence to undergo reduction in their volume while being placed in communication with the exhaust port 121. Ultimately, the chambers attain their minimum volume, at a time when the trailing vane means isolates the chamber from the exhaust port.

It will be perceived from the description of the two stroke pump embodiment of the invention shown in FIG. 7 that the pumping action is obtained as a result of the cylical increase and decrease of the volumes of the chambers defined between adjacent vane means. This pumping action can be used directly, so that the apparatus can be operated as a hydraulic or gas pump. It can also be employed as a hydraulic or compressed gas motor. Further, it will be apparent that the apparatus, as illustrated in FIG. 7, can be utilized simultaneously as a hydraulic motor and hydraulic pump by using one side of the device (that is, the chambers on one side of the rotor) as a motor, and the chambers on the other side of the rotor as a hydraulic pump.

Since the apparatus is a positive displacement device, it can also be used for metering hydraulic (incompressible) fluids. Thus, each revolution, or fraction of a revolution, of the rotor shaft will deliver a flow of a known volume of liquid from each of the exhaust ports when the apparatus is used in this fashion. It can also be used as a metered pump by simply counting the number of revolutions and multiplying by a constant to determine the output from the pump.

In FIG. 8 of the drawings, a modified embodiment of the invention useful as a proportioning or metering apparatus is illustrated. Here a compound housing is provided which includes opposed or facing, internal stationary walls 125, which walls have formed therein, opposed, sinusoidally configured recesses 126 of the type heretofore described. A rotor and sliding vane structure, designated generally by reference numeral 127, is positioned inside the stationary housing walls 125 for rotation with respect thereto, and the vanes are slidably mounted in the rotor so as to follow and seal against the recesses 126 in the opposed walls 125 in the manner hereinbefore described. The internal walls 125 of the compound housing, shown schematically in the embodiment illustrated in FIG. 8, are directionally porous so that fluids to be charged to, and discharged from, the chambers defined between vanes can move in a direction through the walls 125 which is normal to the side of the rotor or, stated differently, parallel to the vanes carried by the rotor, and parallel to the axis of rotation of the rotor. The directional porosity of the internal walls 125 is such that no fluid flow can occur in a direction normal to the vanes carried by the rotor (parallel to the faces of the rotor from which the vanes project).

Sealingly and slidingly mounted outside of the directionally porous internal walls 125 are a pair of movable external housing walls 128. The external housing walls 128 are mounted so that they sealingly engage the directionally porous internal walls 125, and are movable relative to the internal walls by rotation about an axis which is coincident with the axis of rotation of the rotor assembly 127. The movable external housing walls 128 carry ports 129 therein which communicate through the external walls with the directionally porous internal walls 125.

It will be perceived in considering the described structure thus schematically illustrated in FIG. 8 that the position of the movable external walls 128 and the ports 129 carried thereby, in relation to the directionally porous internal walls 125, can be preadjusted so that fluids to be proportioned by the pumping action of the apparatus as hereinbefore described can be proportioned in a precise, predetermined ratio of the fluid charged to fluid discharged by the particular alignment of the ports 129 with particular portions of the recesses 126 which may be selected.

ALTERNATE EMBODIMENT OF THE INVENTION

A modified form of the two-cycle pump illustrated in FIG. 7 of the drawings, which modified form is constructed in accordance with the structural principles described in referring to the preceding figures, is illustrated in FIGS. 9–11. As will be perceived from the following description, the embodiment of the invention illustrated in these latter figures presents the advantage of reducing the energy dissipation and loss resulting from the movement of the ends of the vanes utilized in the two cycle pump depicted in FIG. 7 through an elliptical path during the rotation of the rotor. It will be noted in referring to FIGS. 1–7 that, because of the variation in depth of the recesses, coupled with the requirement that the vanes as a whole be carried in a circular path which is concentric with respect to the axis of rotation of the rotor, the vane tips actually travel in an elliptical orbit. Travel of the vane tips or edges in this path reqires linear or axial acceleration and deceleration of the vanes during each rotation of the rotor.

In an embodiment of the type shown in FIG. 7 where each vane tip passes along the recess to a point of maximum depth once during each rotation, and also once traverses a point of minimum depth of the recess, the need to accelerate and decelerate in the fashion described in traversing the elliptical path will occur twice during each rotation of the rotor, and the acceleration and deceleration accompanied by a reversal in the direction of axial movement (reciprocation) of each vane will be brought about as a result of the camming action of the recess surface contacted by each respective vane as the respective recess changes in its characteristic depth.

The need for the vanes to undergo such acceleration and deceleration along the lines of their axes as a result of the vane tips following the elliptically shaped camming path formed by the variable depth recesses is eliminated in the embodiment of the invention illustrated in FIGS. 9–11.

Referring initially to FIG. 9, the alternate embodiment of the invention is schematically illustrated and includes opposed housing walls, 132 and 133, which have formed therein, substantially parallel recesses, 134 and 136, respectively (shown in dashed lines). For clarity of illustration and explanation, the housing walls 132 and 133 and recesses 134 and 136 have been illustrated in a position such that the shallowest portion **134*a* of the recess 134 appears near the upper side of the housing wall 132 as shown in FIG. 9, and the deepest portion 134*b* of this recess appears near the lower end of this wall of the housing. The deepest portion 136*b* of the recess 136 appears near the top side of the housing wall 133 in FIG. 9, and the shallowest portion 136*a*** of this recess appears near the bottom portion of this housing wall.

The rotor utilized in the embodiment of the invention shown in FIG. 9 is schematically illustrated, and is designated generally by reference numeral 138. The rotor includes a central shaft 140 which is rotatably journaled in the walls 132 and 133 of the housing. The rotor 138 further includes a plurality of radial braces 142, 144, 146 and 148 which are keyed to the shaft 140 for rotation therewith. At their radially outer ends, the braces 142–148 are connected to and support a plurality of sealing means 150–156 which function to seal across the recesses 134 and 136, and between vanes which sealingly engage these recesses in a manner hereinafter described.

In the illustrated embodiment, the rotor 138 further includes a plurality of spokes, two of which, 158 and 160, are illustrated. The spokes 158 and 160 are connected by a pivotal connection at their radially inner ends to an annular hub 159 which pivotally engages a semi-spherical boss 162 carried on the shaft 140. The spoke 160 employed in the rotor 138 of the invention is connected at its radially outer end through a semi-spherical ball-and-socket type joint 166 to a vane-receiving housing 168 forming a portion of a vane means 167. The housing 168 is open at its opposite sides to receive, at one side thereof, a pair of abutting vanes 172 and 174 (see FIG. 11) and, at the opposite side thereof, a pair of abutting vanes 176 and 178. Each of the vanes 172–178 has a rounded outer end formed on a segment of a circle and tapering to a relatively sharp edge as hereinbefore described. The vanes in each pair also cooperate in sealingly engaging the recesses 134 and 136 as has previously been described.

For the purpose of urging the vanes outwardly into sealing contact with the recesses 134 and 136, a pair of angulated wedges, 180 and 182, of trapezoidal configuration, as viewed in side elevation, are positioned inside the housing 168, and bear against the inner ends of the several vanes 172–178, which inner ends are cut on an angle to permit the wedging action to urge them in a direction to seal against the recesses 134 and 136. As will be apparent in referring to FIG. 11 of the drawings, the wedges 180 and 182 are angulated at their central portions to enable them to pass around, and extend outside of, the central portion of the housing 168 which projects radially inwardly and forms the joint 166 which secures the respective vane means to the outer end of the spoke 160.

In similar fashion, the spoke 158 is secured at its outer end through a ball-and-socket type joint 188 to a portion of a vane receiving housing 190. The vane receiving housing 190 slidingly receives the inner ends of two vane pairs which contain the vanes 192 and 194 perceptible in FIG. 9. The vanes in the pair which includes the vanes 192 sealingly cooperate with the recess 134 in the manner hereinbefore described, and the vanes in the pair which includes the vane 194 sealingly cooperate with the recess 136 in similar fashion. A pair of wedge plates 196 are provided in the vane means 167 located at the outer end of the spoke 158, and one of these is visible in FIGS. 9 and 10.

For purposes of explaining the operating characteristics of the embodiment of the invention shown in FIGS. 9–11, the housing walls, 132 and 133, and the recesses 134 and 136 have been illustrated in FIG. 9 so that, a line drawn coincidentally with the longitudinal axis of the vane means 167 at the outer end of the spoke 160 will intersect the shallowest portion 134(*a*) of the recess 134 and the deepest portion 136*b* of the recess 136. This line extends parallel to the axis of rotation of the shaft 140 of the rotor 138. It will be noted that in this position of this vane means 167, the spoke 160 is angled or canted slightly with respect to the rotational axis of the rotor, and does not extend normal thereto.

The same relationship is true of a line drawn coincident with the longitudinal axis of the vane means 167 carried at the radially outer end of spoke 158, and extended through the deepest portion 134(*b*) of the recess 134 and the shallowest portion 136(*a*) of the recess 136. These lines, so drawn, extend parallel to each other and to the axis of rotation of the rotor 138. It will be perceived in reference to FIG. 9, and consideration of the action which occurs upon rotation of the rotor 138, that the vanes, in following the recesses 134 and 136 in the housing walls 132 and 133, will undergo movement about the axis of rotation of the rotor 138 such that the longitudinal axes of the two vane means will sweep through a path which is elliptical about the axis of rotation of the rotor. Stated differently, at the point in the rotation of the rotor 138 which is displaced ninety degrees from the point in the cycle illustrated in FIG. 9, the spokes 158 and 160 will project normal to the axis of rotation of the rotor as a result of the movement of the vane means 167 carried thereby in following the changing depth of the recesses 134 and 136. Therefore, at this time, the longitudinal axes of the two vane means 167 will be displaced further from the axis of the rotor shaft 140 than when these longitudinal axes of the vane means are displaced in the status thereof illustrated in FIG. 9. In other words, at this time when the rotor 138 is displaced 90° from its status shown in FIG. 9, the vane means 167 lie axially along lines which intersect the major axis of an ellipse which symmetrically encircles the axis of the rotor shaft 140.

The tips of the several vanes 172–178 and 192 and 194, however, follow purely circular paths in space and lying in the walls 134 and 133 of the housing during their rotation, such circular paths lying in parallel planes which extend substantially parallel to the bottom of the two recesses 134 and 136, and parallel to the plane occupied by the aligned spokes 158 and 160 as illustrated in FIG. 9.

From the foregoing description of the invention, it will be perceived that the present invention provides a novel, highly useful, positive displacement, swept volume rotary apparatus which achieves significant advantages over both positive displacement reciprocating pumps and conventional turbines. It is to be understood that the principles herein described may be applied in various ways to achieve various results as a particular application or need may require. Different applications of these principles may require different porting and different sealing and lubricating techniques. Nevertheless, it is intended that such changes in details of structure shall be comprehended and included within the spirit and scope of the present invention, except as the same may be necessarily limited by the appended claims, or reasonable equivalents thereof.

What is claimed is:

1. A positive displacement, swept volume rotary apparatus comprising:

a housing having two substantially parallel side wall means, each of said side wall means having an annular recess therein of varying depth extending symetrically around a central axis through the housing, said recesses varying sinusoidally in depth and in width over their entire extent;

a rotor rotatably supported in said housing for rotation about said central axis;

a plurality of spaced vane means slidably mounted in said rotor and each reciprocably slidable relative to said rotor in a direction parallel to the axis of rotation of the rotor, each of said vane means being of equal length as measured between the opposed ends thereof and along lines extending parallel to the rotational axis of the rotor, and each of said vane means comprising:

a first pair of abutting, relatively movable vanes projecting from said rotor, and each having an outer edge at one of said opposed ends of the respective vane means with said outer edges sealingly engaging one of said recesses;

a second pair of abutting, relatively movable vanes projecting from said rotor in the opposite direction from the vanes in said first pair, and each having an outer edge at the other of said opposed ends of the respective vane means, with the outer edges of the vanes in said second pair sealingly engaging the other of said recesses; and wedge means positioned between said first and second pairs of vanes and movable relative thereto by centrifugal force developed during the rotation of said rotor to urge said vanes individually and independently toward the respective recesses; and sealing means on the rotor between adjacent pairs of said vane means, and cooperating with said vane means to partition each of said recesses into a plurality of sealed chambers, each of said sealing means comprising a plate positioned between and contacting adjacent movable vanes in each of said first and second pairs of movable vanes and cooperating with the vanes with which said plate is in contact to sealingly isolate and close portions of said recesses.

2. A positive displacement, swept volume rotary apparatus comprising:

a pair of spaced, opposed, substantially parallel housing walls, each of said walls having a continuous, endless recess of varying depth formed therein, said recesses extending parallel to each other and extending symetrically around an axis extended through said housing walls;

rotor means rotatably mounted between said housing walls and including:

a shaft extending coaxially along said axis and through said housing walls;

brace means projecting radially outwardly from the shaft between said housing walls and keyed to the shaft for rotation therewith;

sealing means carried on the radially outer end portion of said brace means and extending sealingly across portions of the recesses carried on the radially outer end portion of said brace means and extending sealingly across portions of the recesses in said housing walls;

a plurality of spaced spokes projecting radially outwardly from said shaft at a location therealong between said housing walls, each of said spokes being pivotally connected to said shaft for pivotation about a pivotal axis extending normal to said shaft whereby each spoke can pivot between positions in which the respectivie spoke extends at an angle of less than 90° to the axis of said shaft; and vane means pivotally connected to the radially outer end of each of said spokes and each including a pair of vanes extending in opposite directions from the respective spoke and substantially parallel to the axis of said shaft, each of said vanes extending through said sealing means in sealing relation thereto, and each of said vanes having an end sealing against the portion of one of said housing walls which defines one of said recesses.

3. A positive displacement, swept volume rotary apparatus as defined in claim 2 wherein said brace means comprises a plurality of spaced braces each extending radially outwardly from said shaft.

4. A positive displacement, swept volume rotary apparatus as defined in claim 2 wherein each of said vane means is further characterized as including:

a vane housing slidingly receiiving said vanes and pivotally connected to one of said spokes; and a wedge plate positioned between said vanes, movably mounted in said vane housing and responsive to centrifugal force during the rotation of said rotor to urge said vanes in the direction of said housing walls.

5. A positive displacement, swept volume rotary apparatus as defined in claim 4 wherein said brace means comprises a plurality of spaced braces each extending radially outwardly from said shaft, said braces being disposed in two groups located on opposite sides of said spokes, and wherein said sealing means is disposed between said vane housings of the respective vane means and one of said housing walls.

* * * * *

PO-1050
(5/69)

UNITED STATES PATENT OFFICE
CERTIFICATE OF CORRECTION

Patent No. 3,993,417 Dated November 23, 1976

Inventor(s) Walter J. Harrington

It is certified that error appears in the above-identified patent and that said Letters Patent are hereby corrected as shown below:

Column 10, line 58 - change "cylical" to --cyclical--.

Column 15, line 32 - after "recesses", delete the phrase "carried on the radially outer end portion of said brace means and extending sealingly across portions of the recesses"

Column 16, line 24 - change "receiiving" to --receiving--.

Signed and Sealed this

Eighth Day of February 1977

[SEAL]

*Attest:*

RUTH C. MASON
*Attesting Officer*

C. MARSHALL DANN
*Commissioner of Patents and Trademarks*